US005497940A

United States Patent [19]

Vogt

[11] Patent Number: 5,497,940

[45] Date of Patent: Mar. 12, 1996

[54] MAIL BOX SIGNALING DEVICE

[76] Inventor: Michael A. Vogt, 580 Browning Ave. SE., Salem, Oreg. 97302

[21] Appl. No.: 361,651

[22] Filed: Dec. 22, 1994

[51] Int. Cl.[6] ..... B65D 91/00

[52] U.S. Cl. ..... 232/35

[58] Field of Search ..... 232/35, 34, 17

[56] References Cited

U.S. PATENT DOCUMENTS

| | | | |
|---|---|---|---|
| 2,428,423 | 10/1947 | Hurban | 232/35 |
| 2,874,895 | 2/1959 | Opp | 232/35 |
| 3,102,684 | 9/1963 | Eging | 232/35 |
| 3,338,511 | 8/1967 | Cvar | 232/35 |
| 4,190,193 | 2/1980 | Smith | 232/35 |
| 4,798,326 | 1/1989 | Kirry | 232/35 |
| 4,840,307 | 6/1989 | Hartman | 232/35 |

*Primary Examiner*—Flemming Saether
*Attorney, Agent, or Firm*—John P. Halvonik

[57] ABSTRACT

A mail box signaling indicating apparatus made of flexible material to indicate when mail has arrived. The attachment end of the apparatus is doubled back upon itself in order to form a portion that may be clipped around a portion of the wall or other part of the mail box. The other end has a flag shaped indicia and is placed between the door flange and the outer wall of the mail box at the ready position. The indicating end of the device is urged upward by the resiliency of the material when the mail box door is opened and thus indicating that the mail man has been by.

2 Claims, 1 Drawing Sheet

MAIL BOX SIGNALING DEVICE

BACKGROUND AND FIELD OF THE INVENTION

The invention relates to mail box indicators and, in particular, to a mail box indicator that is of one piece construction and fits between the door flange and the side wall of the mail box. The device is of resilient material and is so tensioned between the door flange and the outer wall so that when the door is opened the device will be urged upward to indicate to the owner of the mailbox that the mail has arrived.

The mail box indicating device is designed for use with mail boxes that are in common use nowadays. These mail boxes typically have a front door that is pivotally connected to the front of the box itself. The door of the mail box also has an outer flange that is at right angles to the front surface of the door. The flag shaped portion of the device is bent at right angles and will rest against the flange and the back of the front surface of the door (as well as the outer wall) when the device is in the ready position.

It is believed that by making the indicator out of plastic this will result in long lasting weather-resistant device that can last during prolonged exposure to the elements. Such devices will not rust or be a danger to people.

DESCRIPTION OF THE PRIOR ART

While there are mail box signaling devices in the prior art, such as U.S. Pat. No. 4,798,326 to Keery, that signal the arrival of mail by extending upward and are permanently connected at the side of the box, there are no devices that applicant is aware of that are permanently attached at the top of the box and extend from the side. It is believed that the applicant's device will be more easily seen by one who is in front of the box than the invention of Kerry and similar devices. Some of these devices, e.g that shown of H. C. Specialties of Sandusky, Ohio are of spring-loaded construction and are not of one piece. Such a device would be costly to make and might be dangerous to mail delivery persons as well as the user due to the metallic parts. Such parts are liable to cut someone.

SUMMARY OF THE INVENTION

A mail box signaling indicating apparatus for placement between the door flange and the side wall of the mail box. The apparatus indicates when mail has arrived by moving upward when the door is opened. The apparatus is of one piece construction and of resilient material. One end of the device is the attachment end and is doubled back upon itself thus forming two parallel portions. The attachment end is inserted around a portion of the mail box to form a connection that is more or less, permanently maintained.

The other end has a flag like shape formed by a portion of the material that extends from the stem of the device. The flag portion is bent at an angel perpendicular to itself. This indicating end is placed between the door flange and the outer wall of the box initially-the "no mail" position. The stem of the device will conform to the curved shape of the outer wall of the box in this position. When mail has been delivered, the door will be opened and the indicating end will extend upward due to the resilient nature of the material the device is made of. This "mail arrived" position, will indicate that mail has arrived.

It is among the objects of the invention to provide a mail box signaling device to indicate that mail has arrived.

Another objective is to provide a mail box signaling device that can engage the wall and the door of the mail box in order to provide a signal upon the door of the mail box being opened.

Another objective is to provide a mail box indicating signal that will can endure exposure to the elements.

Another objective is to provide a mail box indicator that can be of one piece construction so as to minimize manufacturing costs.

Another objective is to provide a mail box indicator that is made of resilient material.

Another objective is to provide a mail box indicator that is safe to use and is of materials that are not liable to cut a person.

Other objects of the invention will be apparent to those skilled in the art once the invention is shown and described.

DESCRIPTION OF THE PREFERRED EMBODIMENT

The overall construction of the device includes an attachment end 11 and an indicating end 16. The two ends are connected by a stem 14. All of these portions may be made of one piece, the stem may be about 3 inches in length and the width of the stem may be about ½" in length. The lower, indicating, portion of the device may be slightly larger.

Figure 1:
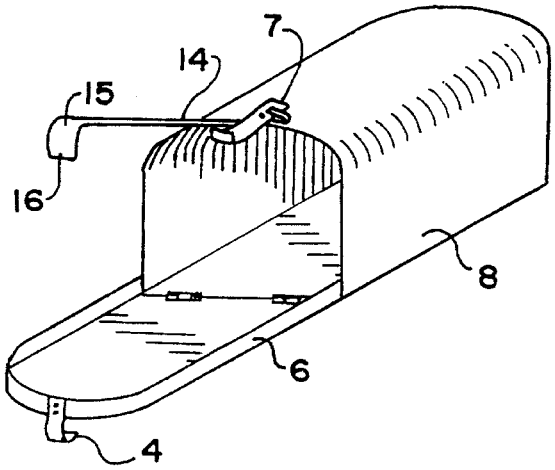
FIG. 1 Mail box with device in "mail arrived" position.
Figure 3:
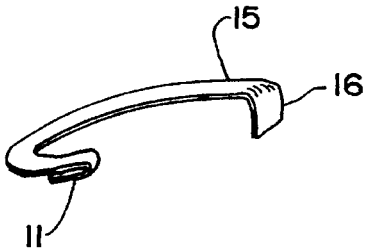
FIG. 3 Front view of the device.

The typical mail box is of construction as shown in FIG. 1. The mail box is open at one end and has a door 2 pivotally attached to the front of it. The side or, outer, wall 8 of the box is typically of curved construction and defines the interior part of the box.

Typically, the front door is pivotally connected to the front of the box beneath the entrance to the interior of the box. The door has a front surface 2 and a flange 6 that is fixed to the front surface of the door and is perpendicular to that front surface. When the door is brought up to close the mailbox, the door flange will be flush or nearly so, against the outer wall of the box.

The lower end, or indicating end, of the device is of a flaglike shape. The flag is formed by a flange 15, 16 that extends from the stem of the device. The flange is bent at right angles to itself to create two portions 15, and 16 that are perpendicular to one another. These portions may be relatively small-about 1" or 1.5" in width and length. Thus, the two portions together that form this end may be about 1–3" in width and height.

This end is placed between the door flange and the outer wall of the box when the user sets the device. Note that usually the door flange will be outside of the outer wall when the door is closed. This is the ready position (no mail yet). The two portions at this end should be between the door flange, and the outer wall of the mailbox when the mail box door is closed and the device is in the ready position.

The upper end or attachment end 11, of the device is folded back on itself to create a doubled construction. Thus creating an upper most portion and a portion just below it.

The two portions are parallel to one another by virtue of the fold line. This portion is inserted around the upper structure 7 of the mail box with the resilient nature of the plastic giving some in order to fit in between this upper portion and the wall of the mail box.

Figure 2:
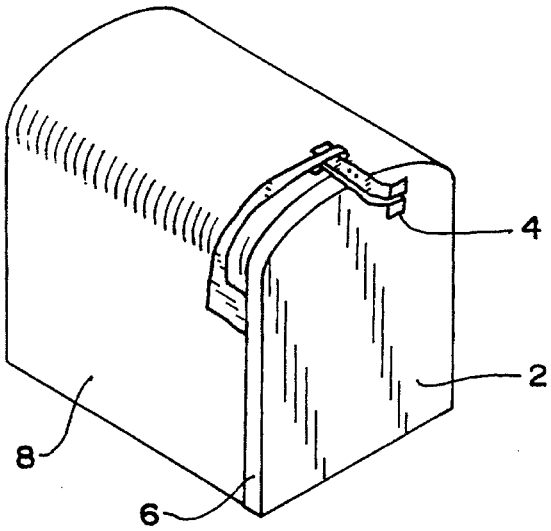
FIG. 2 Mail box with device in "no mail" position
Figure 4:
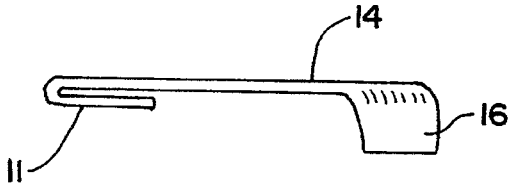
FIG. 4 Side view of the device.

Preferably, this end will be attached to near the top of the box, see FIG. 1–2. There is a piece 7 (sometimes referred to as a "catch bar") usually located at the top most portion of the main wall 8 of the mail box. This piece, as well as the main wall itself, is usually made of metal. The doubled end of the signaling means 11 may be placed around this piece of metal as usually the catch bar is not completely attached to the top of the main wall. The bar 7 is commonly attached to a portion of the top of the main wall, e.g. by a rivet, and hence there is often a narrow gap between that piece and the main wall that can support the end of the signaling means in a more or less permanent manner. Usually, this upper part of the mail box extends forward from the mailbox and engages a similar portion 4 on the door of the mail box. The end 11 of the device may be clipped around this upper part in order to secure the device to the mail box.

After the attachment end has been attached, the indicating end is placed in between the door and the wall and the device is ready to for use, see FIG. 2. The stem of the device will conform to the curvature of the outer wall of the box to accommodate this position as the material is resilient in nature. When the mail box front door is opened, the lower end will be urged upward by nature of the resilient material and this will indicate that mail has arrived or, at least, that the mail box door has been opened. This is the "mail arrived" position, see FIG. 1.

It is preferred that the device by made of flexible plastic or some other resilient material. It is believed that plastic will be quite long lasting after exposure to the elements of nature. The apparatus may be made of one piece construction as this may decrease manufacturing costs.

I claim:

1. A combination mail box holder and signaling device comprising: a mail box having a curved wall having side edges and a bottom wall in connection with said side edges so as to form an enclosed space having at least one open end and having a top most portion running along said curved wall on a line midway between said side edges, said mail box further comprising a door pivotally connected to said bottom wall so as to periodically cover said open end, a catch bar connected to said top most portion of said mail box so as to create a narrow opening between said catch bar and said curved wall, an indicator of flexible material having a securing end and an indicating end, said securing end is of doubled construction so as to form two portions parallel to one another, wherein one of said two portions is placed in said narrow opening, said indicating end having a rectangular shape and adapted to fit between said door and said curved wall when said door is in a closed position.

2. The apparatus of claim 1 where said signaling means is constructed of a flexible plastic material.

* * * * *